US007857362B2

(12) United States Patent
Deblock

(10) Patent No.: US 7,857,362 B2
(45) Date of Patent: Dec. 28, 2010

(54) LOCK FOR TWO-NOTCH LOCKING BOLT COMPRISING A SINGLE SWITCH

(75) Inventor: Luc Deblock, Créteil Cedex (FR)

(73) Assignee: Valeo Securite Habitacle, Creteil Cedex (FR)

( * ) Notice: Subject to any disclaimer, the term of this patent is extended or adjusted under 35 U.S.C. 154(b) by 720 days.

(21) Appl. No.: 11/666,955

(22) PCT Filed: Oct. 17, 2005

(86) PCT No.: PCT/EP2005/055292

§ 371 (c)(1),
(2), (4) Date: May 2, 2007

(87) PCT Pub. No.: WO2006/048373

PCT Pub. Date: May 11, 2006

(65) Prior Publication Data

US 2008/0129058 A1 Jun. 5, 2008
US 2008/0296913 A2 Dec. 4, 2008

(30) Foreign Application Priority Data

Nov. 2, 2004 (FR) ..... 04 11669

(51) Int. Cl.
*E05C 3/06* (2006.01)
*E05C 3/16* (2006.01)

(52) U.S. Cl. ..... 292/216; 292/201

(58) Field of Classification Search ..... 292/201, 292/216

See application file for complete search history.

(56) References Cited

U.S. PATENT DOCUMENTS 4,219,227 A * 8/1980 Grabner et al. ..... 292/216
4,298,223 A 11/1981 Raffelsiefer et al.
5,273,324 A * 12/1993 Kobayashi ..... 292/201
5,564,761 A * 10/1996 Mizuki et al. ..... 292/201
5,785,364 A 7/1998 Kleefeldt et al.
5,810,423 A 9/1998 Brackmann et al.
5,868,444 A * 2/1999 Brackmann et al. ..... 292/201
6,175,202 B1 1/2001 Weyerstall et al.
6,848,727 B1 * 2/2005 Cetnar et al. ..... 292/201
6,886,869 B2 * 5/2005 Martinez et al. ..... 292/216
2003/0080569 A1 * 5/2003 Raymond et al. ..... 292/201

OTHER PUBLICATIONS

International Search Report for PCT/EP2005/055292 mailed Dec. 2, 2005 with translation (4 pages).

* cited by examiner

*Primary Examiner*—Carlos Lugo
(74) *Attorney, Agent, or Firm*—Osha Liang LLP

(57) ABSTRACT

A lock for an opening panel. The lock includes a rotary bolt with first and second locking notches, a strike which can be engaged in the bolt in order to lock the opening panel, a retaining pawl including at least one tooth which co-operates with the locking notches of the bolt in order to lock same in relation to the first or second locking notch, and a switch which is controlled with a control lever. The switch has two states which indicate if the lock is open or closed. In addition, the switch includes a mechanical element which co-operates with the control lever when the lock is closed, such that the switch indicates that the lock is closed only when the tooth of the retaining pawl co-operates with the second locking notch of the bolt. The mechanical element includes a pawl which maintains the control lever in position, thereby preventing the switch from changing from the first state to the second state.

14 Claims, 5 Drawing Sheets

LOCK FOR TWO-NOTCH LOCKING BOLT COMPRISING A SINGLE SWITCH

Figure 1:
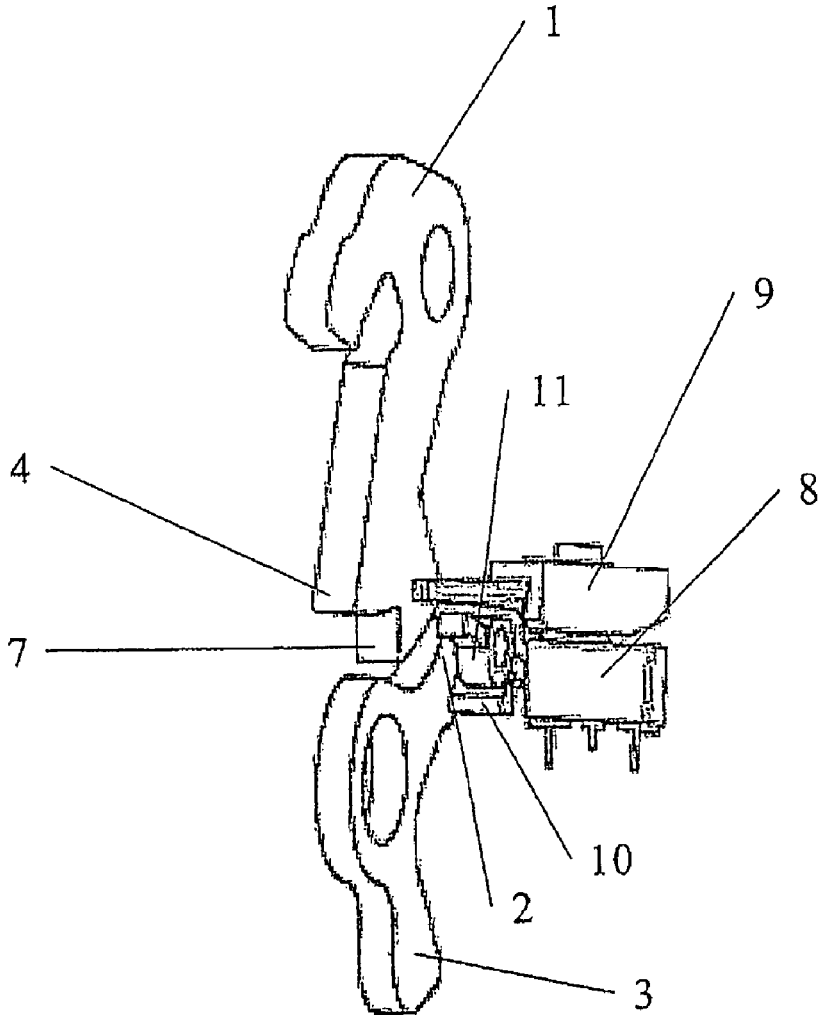

The invention relates to a lock for a locking bolt with two locking notches. More specifically, the present invention relates to such a lock which has a switch to indicate not only that the lock is in the "open" state but also that the lock is in the "closed" state.

At the present time, locks able to detect, on the one hand, whether the door is open or incorrectly closed, that is to say whether the retaining pawl is collaborating with the locking bolt in the first locking notch and, on the other hand, whether the door is closed, that is to say whether the retaining pawl is collaborating with the second locking notch of the locking bolt, are known. Conventionally, this type of lock comprises two switches, one of them devoted to providing information relating to the door being in the "open or incorrectly closed" state and the other being devoted to supplying information relating to the door being in the "closed" state.

It will be noted that, conventionally, the door closed on the first locking notch of the locking bolt is simply equivalent to a "door open" indication given by a switch. The first switch is customarily situated on the locking bolt between the first and second locking notches while the second switch is situated on the retaining pawl.

This type of lock has the major disadvantage of requiring two switches, something which is particularly expensive. Furthermore, the electric circuitry required for operating these two switches is bulky whereas the space available in a lock is very small.

Locks which possess just one switch are also known, for example the lock described in U.S. Pat. No. 6,175,202 which describes a lock using just one switch able to detect the pre-closed position, just before the retaining pawl begins to collaborate with the second locking notch of the locking bolt, in order to start or stop a closure-assist mechanism. The problem with the locks of the prior art that employ just one switch lies in the fact that they are not reliable with regard to the information about whether the lock is in the open or closed state. This is because with just one switch they are able to correctly indicate just one state of the lock: either the "open" state or the "closed" state.

This is because, as a result of problems regarding manufacturing tolerances and because of difficulties associated with the environment, the switch has of necessity at least to be switched just before or just after the second locking notch.

The invention intends to remedy the disadvantages of the devices of the prior art by proposing a lock for opening panels that has just one switch able to indicate for definite whether the lock is in the "open" or "closed" state, that is to say whether the locking bolt is in the open position or in the fully closed position (on the second locking notch), using a means that is simple and effective and does not require complex circuitry.

Thus, the present invention relates to a lock for an opening panel, comprising a locking bolt that is able to rotate, having a first locking notch and a second locking notch, a striker able to engage in said locking bolt in order to hold the opening panel closed, a retaining pawl having at least one tooth collaborating with the locking notches of the locking bolt in order to lock the first or the second locking notch, a switch having two states, able to indicate a first state and a second state, operated by an operating lever, characterized in that it comprises a mechanical means collaborating, upon closure, with the operating lever and the retaining pawl of the lock so that the switch indicates the second state, corresponding to the lock being in the "closed" state, only when the tooth of the retaining pawl is collaborating with the second locking notch of the locking bolt.

According to one embodiment, the mechanical means consists of a holding pawl for retaining the operating lever able to hold said operating lever in position, the fact of holding said operating lever in position preventing the switch from changing state.

Furthermore, a lug of the retaining pawl comes into contact with the holding pawl to force the latter to release the operating lever, this contact occurring more or less at the moment when the tooth of the retaining pawl passes the second locking notch of the locking bolt.

By virtue of the holding pawl that holds the operating lever, the latter does not switch the switch as the pawl drops into the first locking notch which means that information relating to the lock being in the "closed" state is obtained only when the tooth of the retaining pawl is actually collaborating with the second locking notch of the locking bolt.

The invention is described hereinafter in greater detail with the aid of figures which merely depict some preferred embodiments of the invention.

FIG. 1 is a diagrammatic depiction of the lock in the "open" state, the two locking notches of the locking bolt not collaborating with the retaining pawl.

Figure 2A:
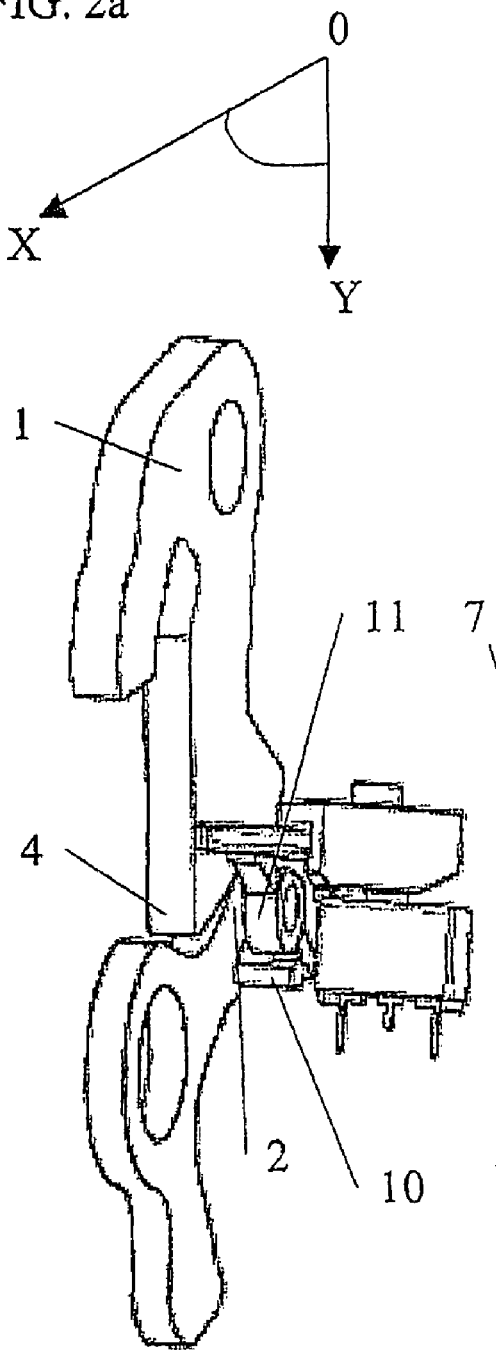
Figure 2B:
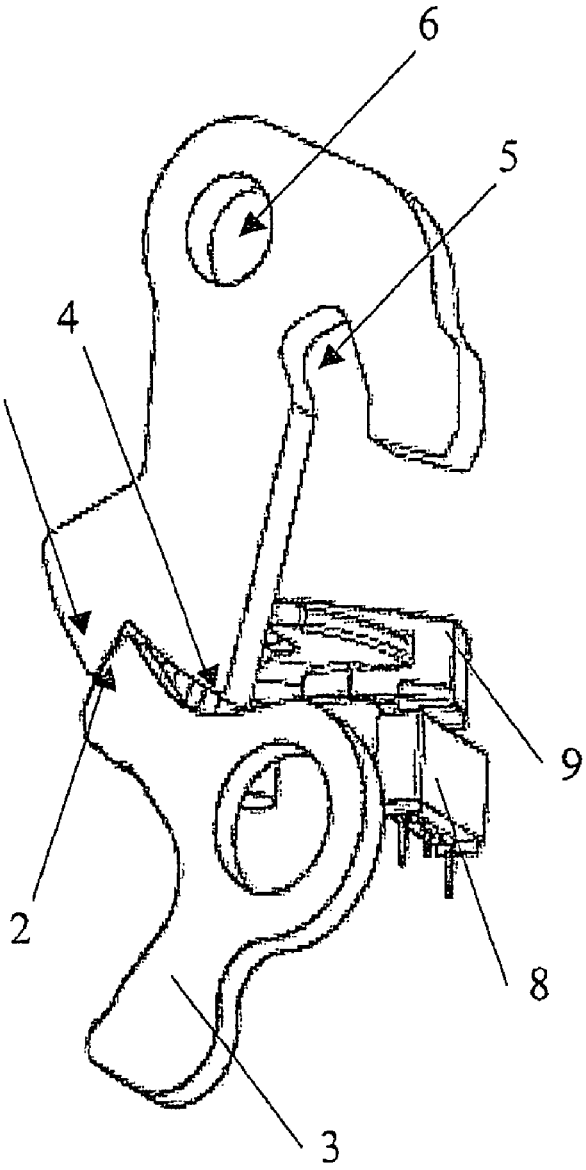

FIGS. 2*a* and 2*b* are two views of a diagrammatic depiction of the lock illustrated in FIG. 1 in the "pre-closed" state, the tooth of the retaining pawl just passing the first locking notch of the locking bolt.

Figure 3A:
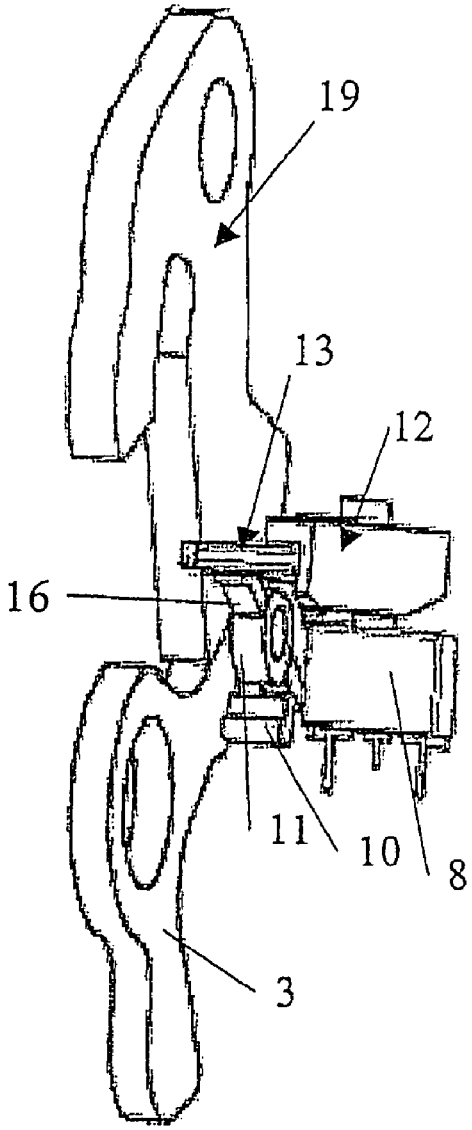
Figure 3B:
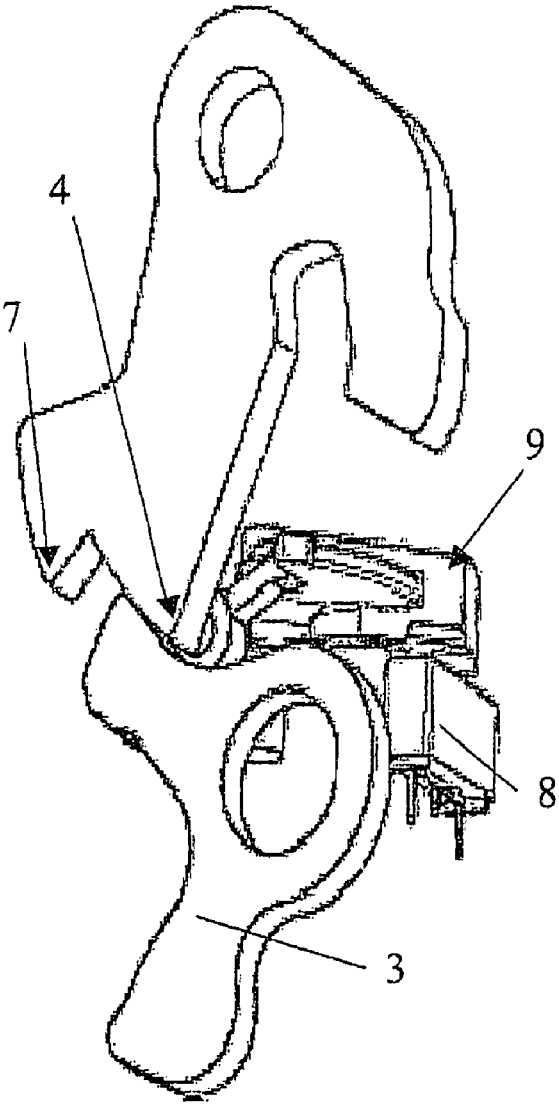

FIGS. 3*a* and 3*b* are two views of a diagrammatic depiction of the lock illustrated in FIG. 1 in the "pre-closed" state, the tooth of the retaining pawl lying between the first and second locking notches of the locking bolt, near to the latter.

Figure 4A:
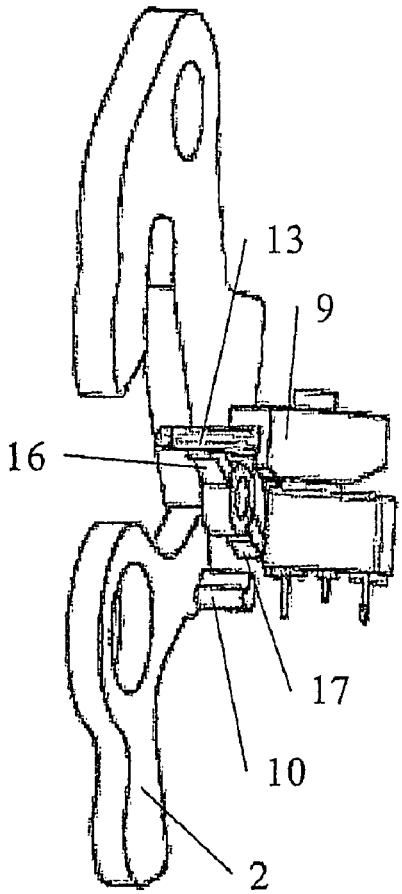
Figure 4B:
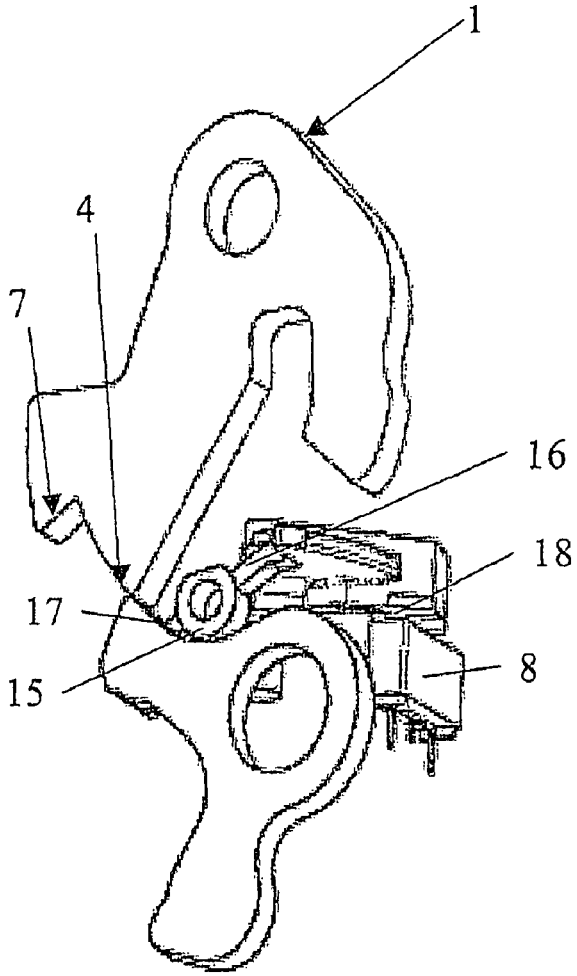

FIGS. 4*a* and 4*b* are two views of a diagrammatic depiction of the lock illustrated in FIG. 1 when the tip of the tooth of the retaining pawl lies more or less against the top of the second locking notch.

Figure 5A:
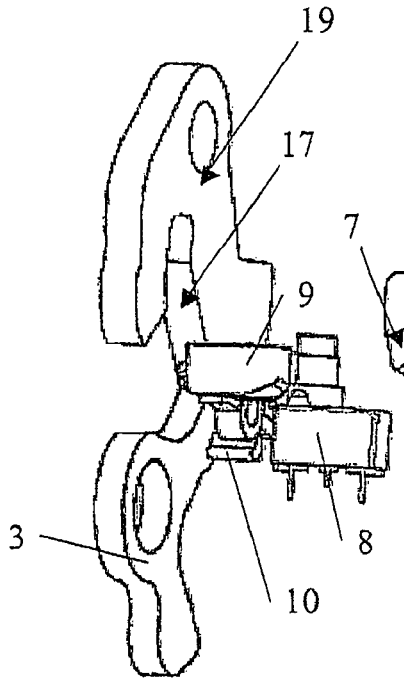
Figure 5B:
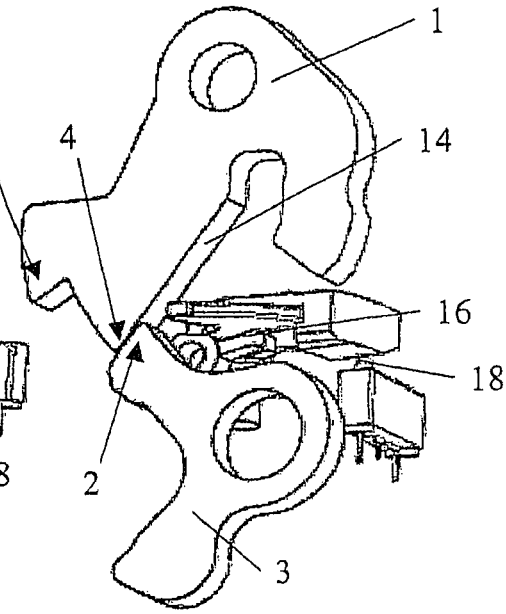

FIGS. 5*a* and 5*b* are two views of a diagrammatic depiction of the lock illustrated in FIG. 1 when the tooth of the retaining pawl has just passed the second locking notch of the locking bolt, that is to say when the lock, or the locking bolt, is in the "closed" position.

Figure 6:
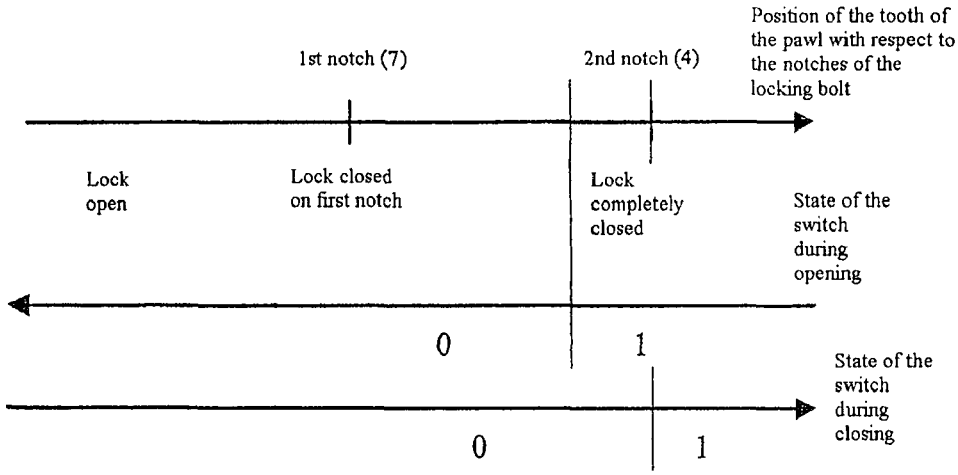

FIG. 6 illustrates the state of the switch—closed (position 1) or open (position 0)—of a lock according to the invention as the lock is opened and closed according to the position of the tooth of the retaining pawl with respect to the locking notches of the locking bolt.

FIGS. 1 to 5 illustrate, in chronological order, the dynamics involved in closing a lock according to the invention, from the position in which the locking bolt 1 is open as illustrated in FIG. 1 to the position in which the locking bolt 1 is closed as illustrated in FIGS. 5*a* and 5*b*. In the context of this patent application, the term "closed" is used to denote the state of the lock when the tooth 2 of the retaining pawl 3 is collaborating with the second locking notch 4 of the locking bolt 1 so as to immobilize the latter 1. Thus, by contrast, the fact that the lock is open will here be indicated by the switch 8 when the tooth 2 of the retaining pawl 3 lies between the first 7 and the second 4 locking notch, against the first locking notch 7 or beyond the first locking notch; it therefore no longer being possible for the tooth 2 of the retaining pawl 3 to begin to collaborate with the locking notches 4, 7.

In the conventional way, the lock comprises a locking bolt 1 having a housing 5 or recess to accept a striker, not depicted in the attached figures. The locking bolt 1 depicted in the attached figures comprises a circular orifice 6 defining its axis of rotation, said locking bolt 1 mounted in the lock being fixed, for example by virtue of a pin fixed to the back plate of the lock, not depicted in the figures, via this orifice 1. The locking bolt 1 is mounted so that it can rotate in a plane XOY and is connected to a return spring, not depicted in the attached figures, pressing against the locking bolt 1 to bring it into its open position in which it does not collaborate with the retaining pawl 3. In this example, in the attached figures, the direction of the force exerted by the return spring of the locking bolt 1 is the clockwise direction in the views of FIGS. 2*a*, 3*a*, 4*a* and 5*a* which show, for example, the front face of the locking bolt 1, and the counter-clockwise direction in the views of FIGS. 2*b*, 3*b*, 4*b* and 5*b* which show the rear face of the locking bolt 1.

The retaining pawl 3 is also a conventional part of a lock. It comprises a tooth 2 which will come into contact or into abutment with the first 7 or second 4 locking notch of the locking bolt 1. The retaining pawl 3 is mounted so that it can rotate and turns in a plane parallel to the plane of rotation XOY of the locking bolt 1.

The lock according to the invention also comprises an on/off switch or switch 8 able to adopt an activated state and a deactivated state, characteristic of the "open" or "closed" state of the lock. This switch 8 comprises a plunger 18 able to slide axially in order to occupy a position in which it protrudes from the switch 8 and a position in which it is retracted inside the switch 8, these two positions of the plunger 18 marking the two states—activated/deactivated—of the switch 8 which correspond to the two states—open/closed—of the locking bolt 1 or of the lock. The plunger 18 is mounted so that it can slide in a passage of the switch 8 and has a spring or the like, not depicted in the attached figures, pressing against said plunger 18 to bring it into its position in which it protrudes from the switch 8. Arbitrarily, we have chosen here to consider that the protruding position of the plunger 18 is the one that signifies that the lock is in the closed state while the retracted position of the plunger 18 is the one that indicates that the lock is in the open state.

The operating lever 9, also termed the sensor, has the function of collaborating with the switch 8, via its contact with its plunger 18, to position it in its two states. Contact between the operating lever 9 and the switch 8 is thus achieved via a plunger 18, said plunger 18 being able to move between a position in which it protrudes from the switch 8 and a position in which it is retracted inside said switch 8. Thus, when the operating lever 9 is not pressing against the plunger 18, as illustrated in FIGS. 5*a* and 5*b*, the switch 8 indicates that the lock is in the closed state, and conversely, when the operating lever 9 is pressing against the plunger 18, the switch 8 indicates that the lock is in the open state. Arbitrarily, we have chosen to consider that when the operating lever 9 is in its rest position, the plunger 18 is depressed. The operating lever 9 can move between a rest position and an extreme position; the rest position being the one in which the operating lever 9 contacts the switch 8 to place it in its first state and the extreme position being the one in which the operating lever 9 does not contact the switch 8 to place it in its second state.

The locking bolt 1, the retaining pawl 3, the switch 8 and the operating lever 9 are conventional parts of a lock and have no special features. Furthermore, the respective functions of these various parts 1, 3 and 8 are identical in the present invention to the functions that they have in locks of the prior art.

Here, only the shape and the relative movement of the operating lever 9 exhibit features specific to the invention. Furthermore, the retaining pawl 3 has a lug 10 intended to come into contact or into abutment with the holding pawl 11 that holds the operating lever 9 so that the holding pawl 11 releases the operating lever 9. This lug 10 runs at right angles to the plane of rotation XOY of the locking bolt 1 and of the retaining pawl 3.

The lock according to the present invention is characterized in that it comprises a mechanical retaining means collaborating with the operating lever 9 to hold the latter 9 in its rest position, that is to say with the switch 8 activated, throughout the phase during which the tooth 2 of the retaining pawl 3 passes from the first locking notch 7 to the second locking notch 4 of the locking bolt 1. Thus, by virtue of this mechanical means 11, information relating to the lock, and therefore the opening panel, being in the "closed" state will be obtained at the switch 8 only when the tooth 2 of the retaining pawl 3 has actually passed the second locking notch 4 and the lock, or the locking bolt 1, is therefore in its closed position.

The operating lever 9 or sensor here comprises a more or less rectangular part 12 intended to contact the switch 8 when the operating lever 9 is in its rest position. The operating lever 9 further comprises a protruding part 13 in the form of a nose. When the operating lever 9 is held in the rest position by the holding pawl 11, the latter 11 supports/retains the operating lever 9, the protruding part 13 of the operating lever 9 resting against the holding pawl 11. The operating lever 9 is mounted so that it can rotate and can turn at right angles to the plane of rotation XOY of the locking bolt 1 and of the retaining pawl 3 from its rest position to its extreme position when the lock is closed, where the operating lever 9 comes into abutment against a flank 14 of the locking bolt 1. A spring, or pressing means, not depicted in the attached figures, acts on the operating lever 9 to bring it into its extreme position.

It will be noted that the operating lever 9 can rotate in a plane perpendicular to the plane of rotation XOY of the locking bolt 1. This in particular allows the part 13 of the operating lever 9 to come into contact with a flank of the locking bolt 1 so that the latter 1, as the lock is opened, returns the operating lever 9 from its extreme position to its rest position.

The mechanical means chosen to illustrate the invention here consists in a holding pawl 11 formed of a circular ring 15 comprising two levers 16, 17. These two levers 16, 17 extend from the circumference of the ring 15, symmetrically on each side of said ring 15. As can be seen in FIGS. 2 to 4, the holding pawl 11, via one of the two levers 16, prevents the operating lever 9 from pivoting and therefore from switching the switch 8. The holding pawl 11 is able to rotate in a plane that is parallel to and offset from the plane XOY of rotation of the locking bolt 1 and of the retaining pawl 3. The holding pawl 11 is situated near the locking bolt 1 and the retaining pawl 3 on one of the sides of the plane XOY.

Starting from FIG. 1, the locking bolt 1 is in the open position, the tooth 2 of the retaining pawl 3 and the locking notches 4, 7 of the locking bolt 1 not collaborating, the operating lever 9 is in its rest position, that is to say that the operating lever 9 is resting against the plunger 18. In this configuration, the protruding part 13 of the operating lever 9 simply rests against a face 19 of the locking bolt 1, the holding pawl 11 that holds the operating lever 9 is not active, that is to say that there is no need for the holding pawl 11 to hold the operating lever 9 in position, the latter 9 already occupying its rest position.

As soon as the locking bolt 1 begins to turn, from its open position towards its closed position, the holding pawl 11 or, more precisely, one 16 of its two levers, positions itself under the operating lever 9 or, more precisely, under the protruding part 13 of said operating lever 9, to hold it in its rest position. In the absence of the holding pawl 11 the operating lever 9, under the effect of its spring, would pivot into its extreme position. Indeed, as the locking bolt 1 rotates towards its closed position, the operating lever 9 is no longer supported by one of the faces 18 of the locking bolt 1, because of the specific geometry of a conventional locking bolt, which means that the holding pawl 11 takes over and holds the operating lever 9 in its rest position, the switch 8 not being switched.

As is evident in FIGS. 3*a* and 3*b*, the holding pawl 11 holds the operating lever 9 throughout the travel of the tooth 2 of the retaining pawl 3 between the first 7 and second 4 locking notch of the locking bolt 1. The operating lever 9 is held in its rest position until the tooth 2 of the retaining pawl 3 has passed beyond the tip of the second locking notch 4, when the tooth 2 of the retaining pawl 3 comes into abutment against the second locking notch 4 to immobilize the locking bolt 1 in its closed position. As illustrated in FIGS. 4*a* and 4*b*, the holding pawl 11 still holds the operating lever 9 in its rest position when the tip of the tooth 2 of the retaining pawl 3 lies more or less facing the tip of the second locking notch 4.

While the tooth 2 of the retaining pawl 3 passes the second locking notch 4, the lug 10 of the retaining pawl 3 comes into abutment against the holding pawl 11, or more precisely against the lever 17 which is the opposite lever to the supporting lever 16, and pushes this lever 17 in such a way that the holding pawl 11 no longer holds the operating lever 9 in its rest position. As soon as the holding pawl 11 moves away from the operating lever 9, the latter 9 pivots into its extreme position and comes into abutment against a flank 14 of the locking bolt 1. In this position, the operating lever 9, or rather the part 12 of the operating lever 9, is no longer in contact with the switch 8 which means that this switch 8 changes state (switches).

Thus, in the example chosen to illustrate the invention, when the locking bolt 1 is in the open position the operating lever 9 actuates the switch 8 in such a way that the switch 8 is in the closed position. This closed position of the switch 8 is maintained as long as the tooth 2 of the retaining pawl 3 has not passed the second locking notch 4, that is to say as long as the locking bolt 1 is in the closed position. Thus, when the locking bolt 1 is in the closed position, the operating lever 9 no longer actuates the switch 8 which means that the switch 8 is in the open position.

The dynamics involved in opening the lock or the locking bolt 1, which are not illustrated in the attached figures, consist in returning or pivoting the operating lever 9 from its extreme position to its rest position. In its extreme position, illustrated in FIGS. 5*a* and 5*b*, which it occupies when the locking bolt 1 is in the closed position, the operating lever 9 butts against a flank 14 of the locking bolt 1 so that when the locking bolt 1, under the effect of its return spring, starts to rotate back from its closed position to its open position, the locking bolt 1 drives the operating lever 9 and forces it to return to its rest position. Specifically, the protruding part 13 of the operating lever 9 pivots under the driving action of the locking bolt 1 and comes to rest against the face 18 of the locking bolt 1. Thus, when the operating lever 9 returns to the rest position, that is to say when it is resting against the face 18 of the locking bolt 1, the operating lever 9 actuates the switch 8 so that the plunger 18 of the switch 8 is depressed.

Finally, at the end of the opening travel of the locking bolt 1, the lug 10 of the retaining pawl 3 comes into abutment against the holding pawl 11 so as once again to align it with the operating lever 9. Thus, during the next dynamic event of closing the opening panel, and therefore the locking bolt 1, the holding pawl 11 will hold the operating lever 9 in the rest position, namely in the position in which the switch 8 is closed.

FIG. 6 demonstrates the moment when the switch 8 changes state (0 or 1) to indicate whether the lock is closed or open. FIG. 6 illustrates the specific feature of the lock according to the invention, namely the fact that the change in state of the switch 8, which indicates whether the lock is in the open/closed state, does not take place at the same instant, or more precisely at the same relative position of the tooth 2 of the retaining pawl 3 with respect to the locking notches 4, 7 of the locking bolt 1 when the lock is being opened by comparison with when the lock is being closed.

Thus, when the lock is being opened, the switch 8 indicates that the lock is in the open state when the tooth 2 of the retaining pawl 3 passes between the first 7 and the second 4 locking notches of the locking bolt 1 (and before the closed state) but when the lock is being closed, the switch 8 indicates the closed state only at the moment when the tooth 2 of the retaining pawl 3 is collaborating with the second locking notch 4, that is to say when the tooth 2 of the retaining pawl 3 is immobilizing the second locking notch 4 of the locking bolt 1. The holding pawl 11 thus holds the operating lever 9 only when the lock is being closed.

Specifically, the tooth 2 of the retaining pawl 3, just like the second locking notch 4 of the locking bolt 1, has the shape of a V, the tips of these two elements 4 and 2 facing towards one another. It is only at the instant that one of the faces of the tooth 2 of the retaining pawl 3 positions itself against one of the faces of the second locking notch 4, immobilizing the locking bolt 1, through rotation of the retaining pawl 3, that the lug 10 of the retaining pawl 3 pushes the holding pawl 11, via its part 17, releasing the operating lever 9 which pivots. The pivoting of the operating lever 9 releases the plunger 18 of the switch 8, causing said switch 8 to change state thus indicating that the lock is in the open state.

In the lock according to the invention, the switch 8 is not operated, that is to say actuated to make it change state, by the same element when the lock is being closed as it is when the lock is being opened:

when the lock is being closed, the switch 8 changes state by virtue of the retaining pawl 3, via its lug 10, which pushes the holding pawl 11, releasing the operating lever 9 which itself releases the plunger 18 of the switch 8, whereas when the lock is being opened, the switch 8 changes state by virtue of the locking bolt 1 which drives the operating lever 9 to cause it to pivot into its rest position in which it presses against the plunger 18 of the switch 8.

The benefit of a lock such as this obviously lies in the use of a single switch 8 but above all lies in the detection of the actual moment when the lock is closed, that is to say the moment when one of the faces of the tooth 2 of the retaining pawl 3 is in contact with one of the faces of the second locking notch 4 to immobilize the locking bolt 1. Thus, when the switch 8 detects that the lock is in the "closed" state it can stop, or send a stop signal to, the closure-assist mechanism generally present on this type of lock. With the lock according to the invention there is no risk, while at the same time minimizing manufacturing and assembly costs, of stopping the closure-assist mechanism too early and running the risk that the lock will not be truly closed.

The invention claimed is:

1. A lock for an opening panel, comprising:

a locking bolt that is able to rotate between an unlock position, an intermediate position, and an unlock position, wherein the locking bolt comprises:

a first locking notch and a second locking notch, a striker able to engage in said locking bolt in order to hold the opening panel closed, a retaining pawl having tooth collaborating with the first and second locking notches of the locking bolt in order to engage with the first or the second locking notch to maintain the lock in the intermediate position or the lock position, respectively, a switch configured to indicate a first state corresponding to the lock being in the "unclosed" state and a second state corresponding to the lock being in the "closed" state, wherein the switch is operated by an operating lever configured to move between a rest position, in contact with the switch to place it in its first state, and an extreme position, not in contact with the switch to place it in its second state, comprising:

a mechanical means collaborating, upon closure, with the operating lever and the retaining pawl of the lock so that the switch indicates the second state, only when the tooth of the retaining pawl is collaborating with the second locking notch of the locking bolt, wherein the mechanical means comprises a holding pawl for retaining the operating lever in position, wherein a lug of the retaining pawl comes into contact with the holding pawl to force the latter to release the operating lever, wherein holding said operating lever in position by the holding pawl prevents the switch from changing from the first state to the second state, wherein when the lock is being opened, the locking bolt returns the operating lever from its extreme position to its rest position.

2. The lock as claimed in claim 1, wherein the lug of the retaining pawl contacts the holding pawl when the tooth of the retaining pawl passes the second locking notch of the locking bolt.

3. The lock as claimed in claim 1, wherein contact between the operating lever and the switch is achieved via a plunger, said plunger being able to move between a position in which it protrudes from the switch and a position in which it is retracted inside said switch.

4. The lock as claimed in claim 1, wherein the operating lever is moved under the action of a return spring whose action is to bring said operating lever into its extreme position.

5. The lock as claimed in claim 1, wherein the operating lever is able to rotate in a plane perpendicular to the plane in which the locking bolt rotates.

6. The lock as claimed in claim 1, wherein it comprises a closure-assist mechanism, said assist mechanism being stopped when the switch detects that the lock is in the "closed" position.

7. The lock as claimed in claim 1, wherein the operating lever is held in position by the holding pawl only when the lock is closed.

8. The lock as claimed in claim 3, wherein the operating lever is moved under the action of a return spring whose action is to bring said operating lever into its extreme position.

9. The lock as claimed in claim 2, wherein the operating lever is able to rotate in a plane perpendicular to the plane in which the locking bolt rotates.

10. The lock as claimed in claim 1, wherein the operating lever is able to rotate in a plane perpendicular to the plane in which the locking bolt rotates.

11. The lock as claimed in claim 3, wherein the operating lever is able to rotate in a plane perpendicular to the plane in which the locking bolt rotates.

12. The lock as claimed in claim 4, wherein the operating lever is able to rotate in a plane perpendicular to the plane in which the locking bolt rotates.

13. The lock as claimed in claim 3, wherein when the lock is being opened, the locking bolt returns the operating lever from its extreme position to its rest position.

14. The lock as claimed in claim 4, wherein when the lock is being opened, the locking bolt returns the operating lever from its extreme position to its rest position.

* * * * *